US005624142A

United States Patent [19]

Watson et al.

[11] Patent Number: 5,624,142

[45] Date of Patent: Apr. 29, 1997

[54] VEHICLE OVERCENTER CLOSURE LATCH

[75] Inventors: Earl L. Watson, Walled Lake; Glenn D. Holland, Southfield; Elden E. Schneck, Troy, all of Mich.

[73] Assignee: Chrysler Corporation, Auburn Hills, Mich.

[21] Appl. No.: 506,450

[22] Filed: Jul. 24, 1995

[51] Int. Cl.[6] ..... E05C 3/04

[52] U.S. Cl. ..... 292/241; 292/97; 292/DIG. 14; 292/DIG. 49

[58] Field of Search ..... 292/113, 241, 292/247, 63, 66, 69, 97, 256, 256.5, 257, DIG. 1, DIG. 16, DIG. 49, DIG. 14

[56] References Cited

U.S. PATENT DOCUMENTS

| | | | |
|---|---|---|---|
| 490,441 | 1/1893 | Jacobus . | |
| 1,382,322 | 6/1921 | Schleicher | 292/247 |
| 1,637,530 | 8/1927 | Moore . | |
| 1,867,846 | 7/1932 | Keeler | 292/DIG. 14 |
| 2,559,681 | 7/1951 | Senseman . | |
| 3,400,963 | 9/1968 | Jablonski | 292/247 |
| 3,602,723 | 8/1971 | Swanson | 292/247 |
| 3,618,995 | 11/1971 | McLean . | |
| 3,628,817 | 12/1971 | Sheahan et al. . | |
| 3,654,453 | 4/1972 | Jablonski | 240/25 |
| 3,892,434 | 7/1975 | Caldwell . | |
| 3,985,380 | 10/1976 | Raivio | 292/120 |
| 4,035,009 | 7/1977 | Jacobs . | |
| 4,540,206 | 10/1985 | Frame . | |
| 4,801,165 | 1/1989 | Pyle . | |

*Primary Examiner*—Steven N. Meyers
*Assistant Examiner*—Gary Estremsky
*Attorney, Agent, or Firm*—Christopher A. Taravella

[57] ABSTRACT

An overcenter latch for securing a closure to a body panel includes a panel bracket disposed opposite a closure striker block with a rubber link pivotally connecting the bracket and an operating handle. The block has spaced apart outwardly opening recesses each having a transverse raceway providing opposed inboard and outboard pivot sockets. A pair of depending handle prongs, each terminating in an arcuate cam, are adapted to snap overcenter on an associated raceway for pivotal reception between respective inboard and outboard pairs of sockets. The cams are readily positioned in their associated inboard sockets without the link being tensed. During latching, the handle cams are initially rotated about an inboard socket axis to an overcenter point, wherein the link is tensed to a predetermined dimension less than the links theoretical latching overcenter length. At this point the cams snap outboard to their associated outboard pivot socket axis, whereby the handle is rotated to its latched position resulting in reduced operator latching effort. During unlatching, the handle cams are initially rotated about the outboard socket axis to an overcenter point, wherein the link is tensed to a predetermined dimension greater than the link's theoretical latching overcenter length resulting in increased operator unlatching effort, obviating inadvertent unlatching.

8 Claims, 3 Drawing Sheets

VEHICLE OVERCENTER CLOSURE LATCH

FIELD OF THE INVENTION

This invention relates to overcenter latches for securing a pair of relatively movable members and, more particularly, to such latches which include an elastomeric tension link pivoted to an operating handle providing tensed overcenter engagement with a striker block.

It is well known in the art to use overcenter latches, which include an elastomeric tension link, for releasably securing movable hood members of off-road or sport-utility type vehicles. One example is U.S. Pat. No. 3,985,380 issued Oct. 12, 1976 to Raivio, entitled "Overcenter Type Latch". The Raivio patent, which discloses a latch for relatively movable hood members of a tractor vehicle, includes a retainer of molded plastic secured to one member and having laterally spaced recesses adjacent one end thereof and a striker adjacent the other end thereof. An operating handle has spaced abutments adjacent one end received within the retainer recesses for pivotal movement of the handle between a latched position and an unlatched position. An elastomeric link, pivoted to the operating handle and to the other hood member, is tensed when the handle is in latched position and extends between the spaced recesses and abutments. A manually operated latch, integral with the handle, cooperates with the striker to block movement of the handle to an unlatched position unless the latch is manually released.

SUMMARY OF THE INVENTION

It is a feature of the present invention to provide an overcenter latch assembly for releasably securing a closure to a body panel including an elastomeric link pivotally connected between a body panel bracket and an operating handle. The handle has a pair of laterally spaced apart prongs terminating in arcuate cams adapted for engagement with associated fore and aft transversely extending recesses formed in a closure striker block. Each recess includes a raceway terminating in opposed inboard and outboard pairs of pivot sockets, wherein the inboard and outboard sockets define respective inboard and outboard pivot. axes.

It is yet another feature of the present invention to provide an overcenter latch assembly wherein the elastomeric link and handle are conjointly rotated by the operator about the bracket pivot pin in a latching direction, while the handle is adapted for rotation about its pivot axis relative to the link, enabling the pair of handle cams to be initially received in associated ones of the striker block inboard pair of pivot sockets without any elongation of the link.

It is still another feature of the present invention to provide an overcenter latch assembly wherein, with the handle cams seated in their associated inboard pivot sockets, the operator initially rotates both the handle and the link in the latching direction with the handle pivoting about the inboard pivot axis and the link pivoting about the bracket pin axis. The pair of recess raceways define a first plane disposed at a predetermined slope angle which, upon the handle being initially rotated to a position substantially 90 degrees to the raceway plane, the tensed link causes the handle cams to snap outboard from the inboard sockets and seat in their associated outboard sockets. During latching, this translation of the pivot axis occurs prior to the link being rotated to its maximum tensed overcenter position.

In accordance with the present invention such elastomeric link induced translation of the handle cams to their outboard pivot axis during latching causes the elastomeric link to snap the handle cams into their outboard pivot sockets at the handle's overcenter point. As a result, further tensing rotation of the link required to reach a theoretical link overcenter point where the link would be tensed to its theoretical overcenter tensed length, established by the inboard rotational axis, is obviated. That is, continued rotation of the handle about the outboard pivot axis results in reduced link tensing and, accordingly, reduced operator effort needed to complete the handle and link rotation to their latch engaged mode.

It is still another feature of the present invention to provide an overcenter dual-pivot axis latch assembly that increases the operator effort required to disengage the latch when compared to the effort required to engage the latch. Such latching/unlatching effort differential is achieved because, during unlatching, the handle is initially pivoted about the outboard pivot axis through a predetermined first rotational angle, wherein the link first passes through its theoretical overcenter position at which point it is tensed to its theoretical overcenter tensed length. At this point, however, the slope angle of the raceway plane relative to the handle radially extending plane is less than 90 degrees, thereby preventing the pair of handle cams from snapping inboard to their associated inboard pivot sockets. As a consequence, the operator continues to rotate the handle about the outboard axis through an additional angle further tensing the link, at which point the handle reaches its unlatching overcenter point, i.e. where the radial plane of the handle is substantially normal to the plane of the raceway, allowing the handle cams to snap inboard to their inboard pivot sockets.

It is another feature of the present invention to provide a tension clamping hood latch as set forth above wherein the elastomeric link, upon being rotated to its latched position occupies a recess defined between the striker block side walls, shielding the link from damage.

It is yet another feature of the present invention to provide a tension clamping overcenter latch assembly as set forth above wherein the elastomeric link annular eye portion, pivotally connected to the handle, is adapted to resiliently contact a stop portion on the striker block at a predetermined handle overcenter latching position, thereby obviating latching noise caused by direct overcenter impact of the latch handle on the striker block.

These and other features and advantages of the invention will be more fully understood from the following detailed description of the invention taken together with the accompanying drawings.

DETAILED DESCRIPTION OF THE INVENTION

Figure 1:
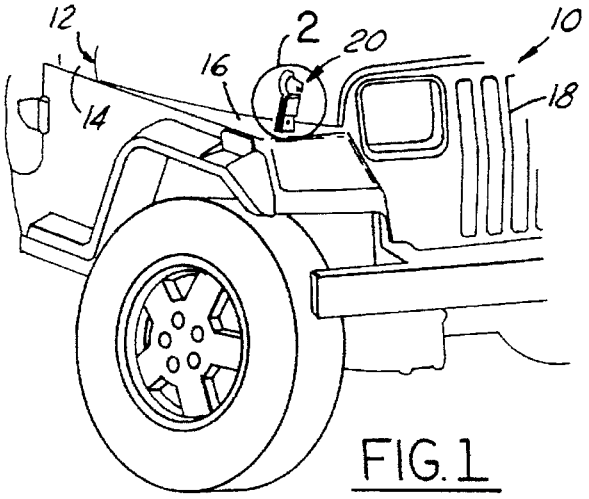
FIG. 1 is a fragmentary perspective view of a vehicle body right hand side and front end portion showing an exterior hood latch according to the present invention.
Figure 2:
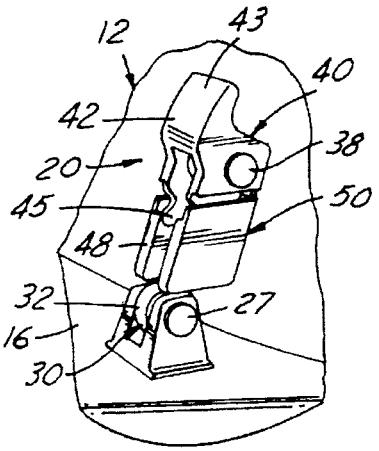
FIG. 2 is an enlarged fragmentary perspective view showing a portion the right hand hood latch enclosed within a circle denoted "2"

Referring now to the drawings, and specifically to FIG. 1, the right front side of a sport utility type vehicle, such as a "Jeep" vehicle for example, is indicated generally at 10. A panel member or hood closure 12, pivotally supported to the body cowl panel 14, covers the vehicle engine compartment opening when the closure is in its closed position of FIG. 1. When the closure is rotated to its raised position, the compartment is open allowing access to the engine compartment which is bordered by a pair of substantially horizontally disposed side panels 16 and the forward grill 18. The closure 12 is secured to the side panels 16 by a pair of right and left side latch assemblies with only the right side latch assembly being shown generally at 20 in FIGS. 1 and 2.

Figure 3:
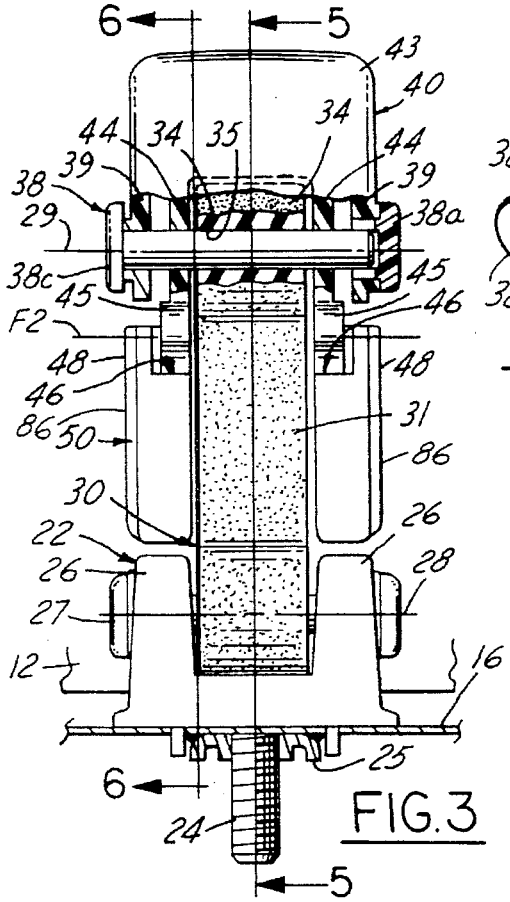
FIG. 3 is a fragmentary front view, with parts broken away, of the hood latch in its closed position.
Figure 4:
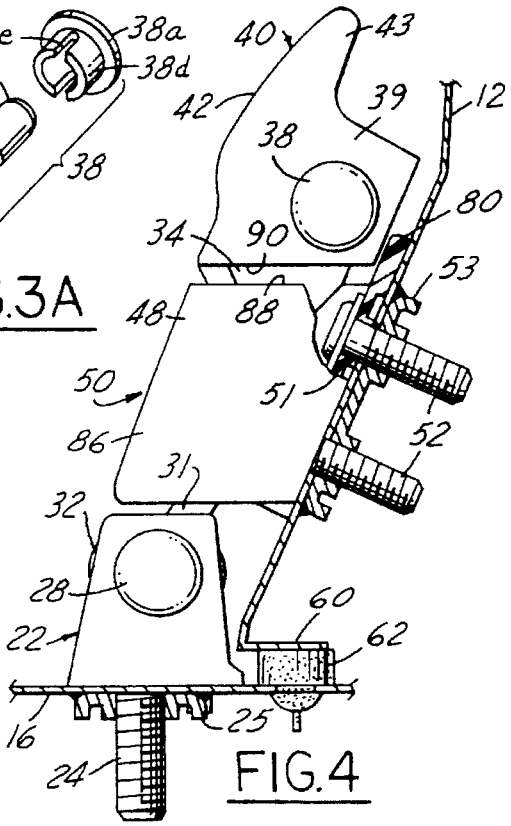
FIG. 4 is a fragmentary side view of the hood latch of FIG. 3.
Figure 5:
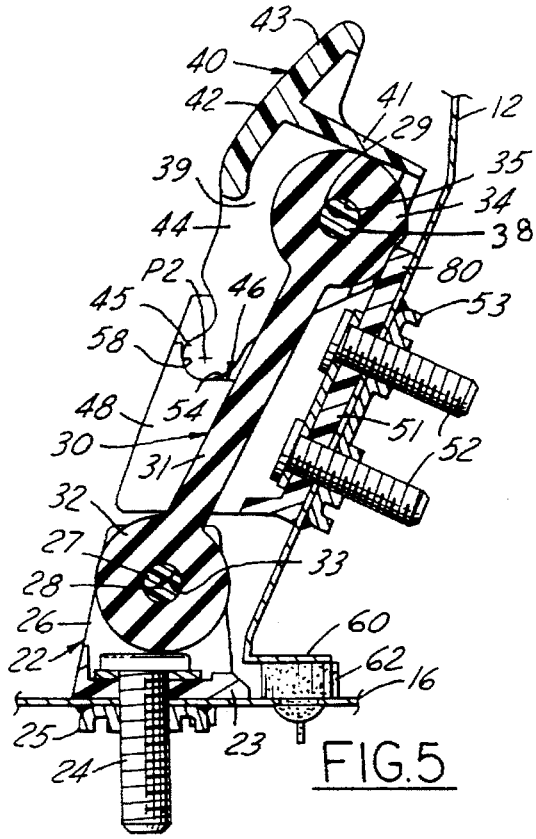
FIG. 5 is a fragmentary vertical cross sectional view taken on the line 5—5 of FIG. 3.

With reference to FIGS. 3 and 4 the latch assembly 20 comprises a U-shaped clevis bracket 22 of molded plastic material having a base portion 23 secured by bolt 24, shown in FIG. 5 extending through the side panel 16 and retained by underlying nut 25. The bracket 22 has a pair of upstanding apertured ears 26 receiving a longitudinally extending lower pivot pin defining a longitudinally extending lower pivot axis 28. The lower pin 27 rotatably supports one lower end of a stretchable rubber link 30 of symmetrical "dog bone" shape. The link 30 includes an elongated rectangular-sectioned bar 31 formed with an enlarged annular eye 32 at its lower end, having a center bore 33 receiving a lower pivot pin 27. The link 30 has an identical upper annular eye 34, having a center bore 35 receiving a longitudinally extending upper pivot pin 38, defining a longitudinally extending upper pivot axis 29 at its upper end.

Figure 13:
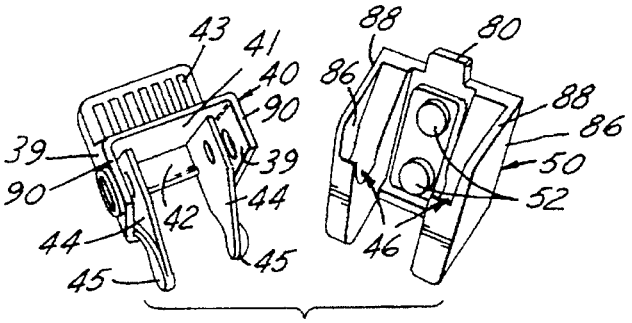
FIG. 13 is a perspective detail view of the latch handle and striker block.

As seen in FIG. 3 the upper eye 34 is adapted for pivotal movement between laterally spaced side walls 39 of a plastic operating handle 40 formed of molded plastic material. As best seen in FIG. 13 the handle side walls 39 are joined at one end by an upper end wall 41. The side walls 39 and end wall 41 extend normally from an outer bight wall 42 (FIG. 5) having a contoured outer face terminating at its upper end in a finger gripping flange 43.

Figure 3A:
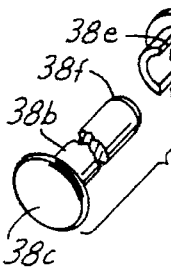
FIG. 3A is an exploded detail perspective view, with a part broken away, of one pivot pin assembly of the hood latch.

In FIG. 3A there is shown a two-piece upper pivot pin 38, molded of suitable plastic material, which pin is the same as the lower pivot pin 27. The pivot pin 38 includes a head cap **38*a* and a pin shank 38*b* formed with an integral head 38*c*. The head cap 38*a* has an integral collar portion 38*d*, formed with opposed yield slots 38*e*, allowing the collar to telescopically receive a free end of the shank 38*b*. The shank free end is formed with an annular groove 38*f* adapted for capture by a mating internal rib 38*g*** of the collar in snap action manner.

FIGS. 3, 5 and 13 show a pair of laterally spaced apart fore and aft elongated prongs 44, offset inwardly from and parallel with their associated handle side walls 39. The prongs 44, integral with the upper end wall 41, project downwardly therefrom with each prong 44 terminating at its free end in semi-spherical arcuate cam 45. It will be noted in FIG. 7 that the semi-spherical cam contour is generated about a center of pivot "P" having a radius of curvature "R" of predetermined dimension.. Each cam 45 is adapted to be received in an associated one of a pair of fore and aft laterally spaced apart recesses, generally indicated at 46 in FIG. 13. Each recess 46 is formed in an associated upper edge portion of a pair of laterally spaced apart side walls 48 of U-shaped striker block 50.

Figure 6:
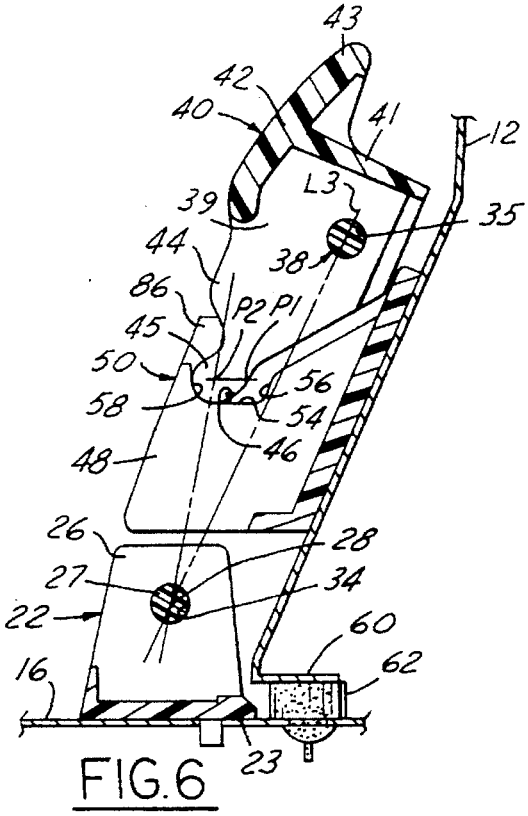
FIG. 6 is a fragmentary vertical cross sectional view taken on the line 6—6 of FIG. 3.

Referring to FIG. 4, the striker block 50 is secured by a pair of upper and lower bolts 52, extending through closure 12, and received in associated threaded bores of a backing plate 53 welded to the closure inner surface. With reference to FIG. 6, it will be seen that each upwardly opening elongated recess 46 defines a transversely extending planar raceway 54 of predetermined extent. Each raceway 54 terminates in opposed inboard 56 and outboard 58 pivot sockets. The pair of opposed inboard and outboard pivot sockets 56 and 58 are each sized for pivotal seating of an associated fore or aft prong semi-circular arcuate cam 45 in a manner to be described.

Figure 12:
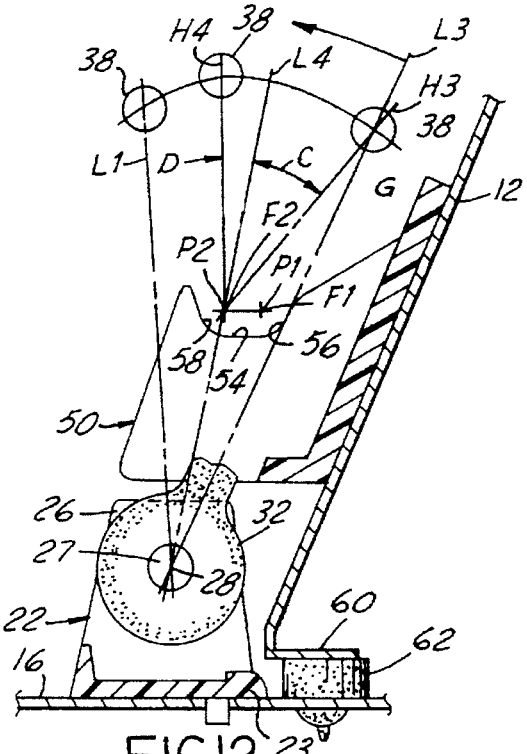
FIG. 12 is a view similar to FIG. 11, showing the unlatching sequence.

Referring to FIG. 12 it will be seen that the inboard pivot socket 56 is defined by a center of pivot "P1" about which a predetermined radius of curvature "R" generates concave semi-spherical surface of the socket 56. It will be appreciated that the radius of curvature "R" of cam 45, (FIG. 7), has the same dimension as inboard pivot socket radius of curvature "R" of FIG. 12. Consequently, with the pair of handle cams 45 seated in their associated inboard sockets 56, the handle is adapted for pivotal movement about a longitudinally extending inboard pivot axis "F1" which includes the fore and aft pivot centers "P1".

Figure 11:
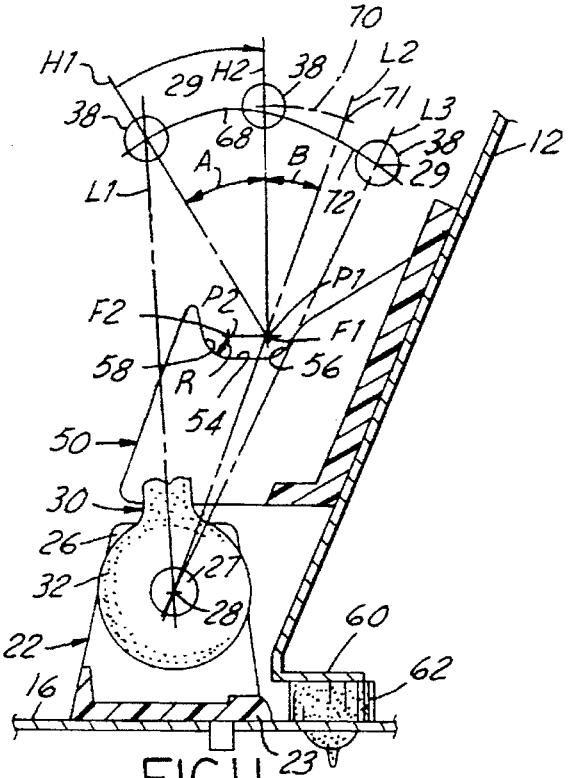
FIG. 11 is an enlarged partially diagrammatic fragmentary sectional view showing the latching sequence.

With reference to FIG. 11, each outboard pivot socket 58 is defined by an outboard center of pivot "P2" which has the same radius of curvature "R" as each inboard pivot socket 56. Thus, upon the handle cams 45 being snapped outboard on their associated raceway 54 from the inboard pivot sockets 56 to seat in the outboard sockets 58 the handle 40 is adapted to pivot about an outboard longitudinally extending pivot axis "F2".

Figure 7:
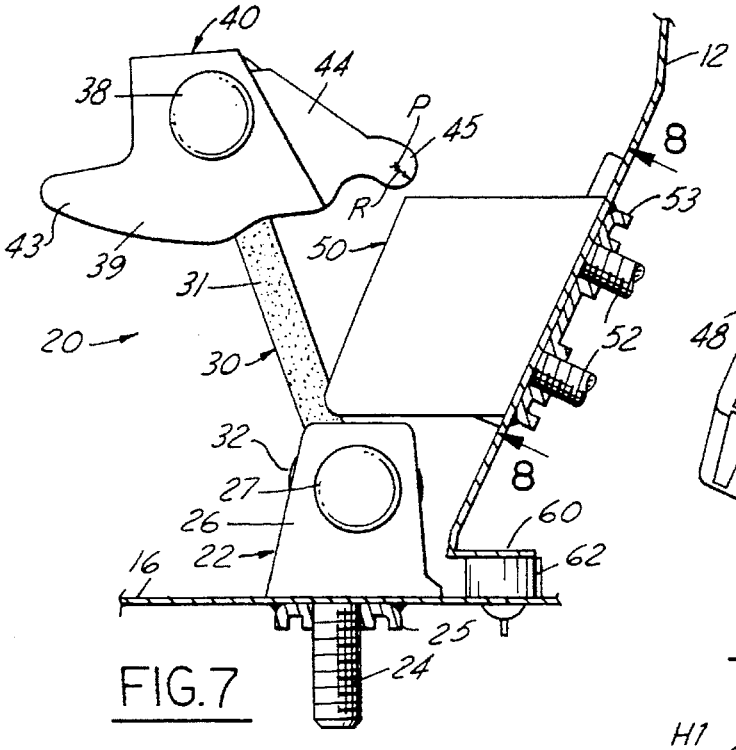
FIG. 7 is a fragmentary side view of the hood latch in its open position with the operating handle rotated counter-clockwise to a non-engaged position.
Figure 10:
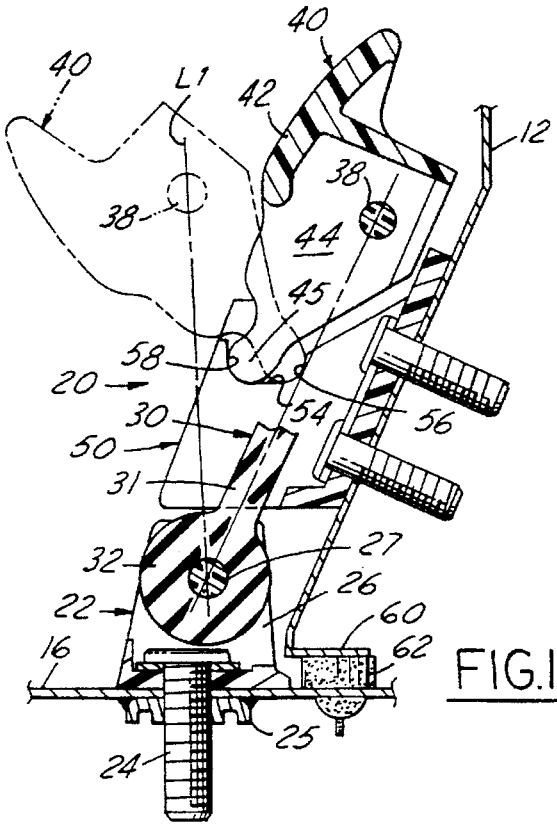
FIG. 10 is a view similar to FIG. 8 wherein the operating handle is shown rotated clockwise to its engaged over-center position.

In operation, FIG. 7 shows the two members 12 and 16 adapted to be latched, with the striker block 50 in opposed relation to the bracket 22. In the disclosed embodiment, upon the hood closure 12 being lowered, each side edge in-turned flange 60 is positioned over an associated body panel 16 for engagement with an elastomeric panel seal 62. With the latch handle 40 spaced from the striker block 50, the link 30 and handle 40 are first swung clockwise into initial engagement, indicated by dashed radial line "L1" in FIG. 10, with the link 30 remaining in its non-tensed mode, i.e. without the link 30 undergoing any elastic elongation.

Figure 9:
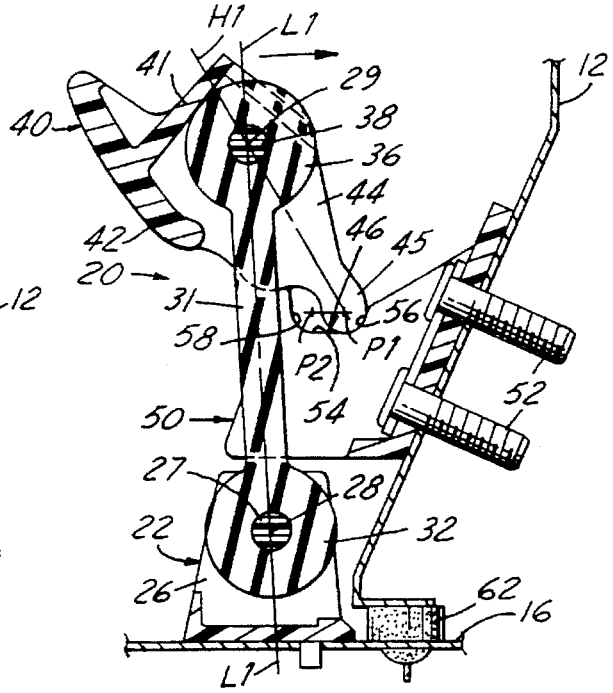
FIG. 9 is a fragmentary side view of the hood latch showing the operating handle pivoted to its initial unlatched over center mode.

With reference to FIG. 9 the pair of cams 45 are shown seated in their associated inboard sockets 56, with the handle 40 adapted to pivot clockwise about inboard longitudinal pivot axis "F1" in the direction of the arrow. In FIG. 11 the handle 40 is shown rotated clockwise through a predetermined angle "A", from initial radial line "H1" to a handle overcenter position, indicated by radial line "H2". It will be seen that during its angle "A" travel the handle pivot pin axis 29 follows arcuate path 68, wherein link 30 is tensed to a predetermined elongation about inboard axis "F1".

It will be noted in FIG. 11 that the handle latching overcenter line "H-2" defines a radially extending plane which intersects the plane of the raceways 54 at an angle of substantially 90 degrees. As a result, the tensed link 30 causes the cams 45 to snap outboard on their associated raceways 54, i.e. the cams 45 translate from their inboard sockets 56 to their outboard sockets 58. The operator continues rotating the handle about the outboard pivot axis "F2", thereby causing the link 30 to swing through its theoretical link overcenter line "L2" to its latched position, indicated by line "L3". FIG. 11 shows the theoretical overcenter line "L2" defining a radial plane that includes axis bracket pivot axis 28, inboard pivot axis "P1", and handle pivot axis 29.

In the example illustrated in FIG. 11, the angle "B" defines the theoretical additional rotational path required if continued handle rotation occurred about the inboard axis "F1" along dashed arcuate line 70. In such a case, the link 30 would undergo an additional extension to a theoretical overcenter tensed length defined by intersection 71 of theoretical overcenter line "L2" with the dashed arcuate line 70. Thus, by virtue of handle cams being snapped outboard to the pivot axis "F2" the handle pivot pin axis 29 travels along a new arcuate path 72 wherein the link tensed length is reduced. In the disclosed embodiment, the angle "A" is about 30 degrees and the angle "B" is about 20 degrees.

With reference to FIG. 11 it will be seen that, upon the handle cams 45 being translated to their outboard pivot sockets 58, the link tensed length decreases as the handle pin moves from its overcenter line "H2" to the handle latched line "L3" along an arcuate path 72. In the latched mode, the link 30 maintains a predetermined portion of its tensed length to resiliently retain the latch handle and link in their "L3" overcenter latched position.

With reference to FIG. 12, the latch 20 is shown in its FIG. 6 latched mode, with the cams 45 shown seated in their associated outboard pockets 58, wherein the handle 50 is adapted for initial pivotal counter-clockwise un-latched movement about outboard longitudinal pivot axis "P2" in the direction of the arrow. The handle 50 is rotated through a predetermined angle "C" from line "L3" to theoretical link overcenter line "L4" defining a plane which includes the lower pin axis 28 and the outboard axis "F2". It will be noted in FIG. 12 that the overcenter line "L4" defines a radially extending plane which intersects the plane of the raceways 54 at a predetermined acute angle "G" of about 80 degrees. As the acute angle "G" is about ten degrees less then the required 90 degrees, the handle 40 must rotate through an additional ten degree angle "D" before the handle cams 45 snap inboard on their raceways 54 to their associated inboard pivot sockets 56.

Thus, during unlatching, as the handle 50 rotates beyond link overcenter line "L4", the link 30 is tensed a predetermined dimension greater than its theoretical overcenter tensed length "L4" dimension. As a result, the effort required for unlatching is substantially increased, thereby insuring against inadvertent unlatching of the hood 12.

Figure 8:
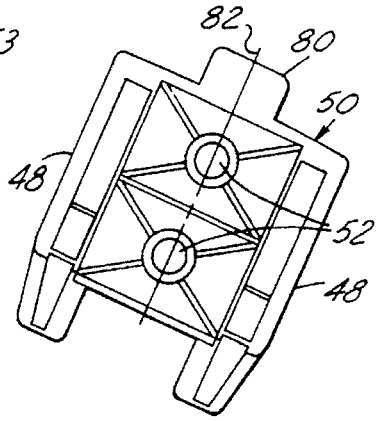
FIG. 8 is an elevational view of the striker block taken on the line 8—8 of FIG. 7.

It will be noted in FIGS. 7 and 8 that the striker block 50 is formed with an upstanding stop tab 80 symmetrically disposed about its plane of symmetry defined by centerline 82 in FIG. 8. With reference to FIG. 5, it will be seen that the tab 80 is adapted to be contacted by the upper enlarged annular eye 34 of the rubber link 30 upon the latch handle being rotated to its latched position. The stop tab 80 is thus positioned to initially contact the link upper annular eye 36 prior to portions of the handle 40 impacting on the striker 50. Accordingly, the latch 20 provides a resiliently cushioned latching stop thereby obviating a harsh impact noise caused by direct handle to striker block contact.

FIG. 5 shows the rubber link 30 positioned in a recessed manner below the outer exterior portions of the latch striker block and handle in its latched mode. By virtue of this design feature, applicants' latch thereby minimizes the possibility of the link being damaged.

With reference to FIG. 13 it will be seen that the striker recesses 46 are laterally offset inward on the striker side walls 48 to receive their associated laterally offset prong arcuate cams 45 in a complementary manner. It will be noted in FIGS. 3 and 4 that thin outer side wall portions 86 of the striker conceal the offset prong cams 45 when the latch assembly is viewed from the side. Further, it will be observed in FIG. 4 that striker side wall upper edges 88 are positioned in parallel juxtaposed relation to opposed handle side wall lower edges 90, thereby concealing internal portions of the latch such as the prongs 44 and the cams 45.

Although the invention has been described by reference to a specific embodiment, it should be understood that numerous changes may be made within the spirit and scope of the inventive concepts described. Accordingly, it is intended that the invention not be limited to the described embodiment, but that it have the full scope defined by the language of the following claims.

What is claimed is:

1. An overcenter latch assembly for securing a pair of relatively movable members together comprising:

a bracket for securement to one member and a striker for securement to a second member in opposed relation with said bracket, an elastomeric link having its respective ends pivotally connected to said bracket and to a latch handle, with each connection defining a longitudinal pivot axis;

said striker having fore and aft longitudinally spaced apart transversely extending recesses formed therein, each said recess formed with a transversely extending raceway ending in opposed inboard and outboard pivot sockets;

longitudinally spaced apart fore and aft prongs extending from said handle with each prong free end defining an arcuate cam, each said cam adapted to be received in an associated inboard socket for pivotal movement of said handle about an inboard axis in a latching direction from an initial unlatched position;

said raceways being oriented in a direction substantially perpendicular to a longitudinal axis of the elastomeric link with the latch in a latched position such that initially rotating said handle and link in a latching direction pivots said handle about said inboard axis through a predetermined first angle so as to tense said link to a first overcenter length that causes said cams to snap outboard on their raceways and seat in their associated outboard sockets, whereby continued rotation of said handle about an outboard axis to the latched position causes said link length to diminish to a tensed length a predetermined dimension less than said overcenter tensed length resulting in reduced effort to latch said assembly.

2. The latch assembly as set forth in claim 1 wherein initially rotating said handle and link in an unlatching direction pivots said handle about said outboard axis through a predetermined second angle determined by said raceway orientation so as to tense said link to a second overcenter length greater than said first overcenter length, thereby increasing the unlatching effort required to cause said cams to snap inboard on their respective raceways and seat in the associated inboard sockets, continued rotation of said handle about said inboard axis returning the handle to said initial unlatched position.

3. The overcenter latch assembly as set forth in claim 1 wherein said latched position is determined by a portion of said elastomeric link contacting an opposed portion of said striker, thereby lessening handle latching impact noise.

4. The overcenter latch assembly as set forth in claim 3 wherein said link is formed with identical enlarged annular eye portions at its upper and lower ends, each said eye portion having a center bore receiving an associated upper handle pivot pin and lower bracket pivot pin therethrough, and said link upper annular eye portion contacts an opposed tab portion of said striker.

5. An overcenter latch assembly as set forth in claim 1 wherein said striker has a channel-shape when viewed in horizontal section defining a back wall and a pair of fore and aft side walls extending outboard therefrom, each said side wall having an upwardly facing edge portion forming one of said recesses.

6. An overcenter latch assembly as set forth in claim 1 wherein said striker has a channel-shape when viewed in horizontal section defining a back wall and a pair of fore and aft side walls extending outboard therefrom, said side walls defining opposed inner surfaces spaced a predetermined longitudinal dimension apart, wherein said link is adapted to be received therebetween in said assembly latched position such that said link central portion is recessed from outboard facing edge portions of said side walls, whereby said link central portion is shielded against damage.

7. The overcenter latch assembly as set forth in claim 1 wherein said handle is defined by forward and aft side walls joined by an integral outboard facing wall, said forward and aft prongs being inwardly offset from their associated side walls, whereby said prongs are longitudinally spaced a predetermined dimension less than the longitudinal spacing between said handle side walls.

8. An overcenter translating pivot latch assembly for securing a movable closure member to a vehicle body comprising in combination:

a bracket adapted for attachment to the vehicle body and a U-shaped striker adapted for attachment to the closure member in upstanding relation to the body portion, a latch handle and an elongated elastomeric link having one end pivotally connected to a longitudinally extending latch handle pivot pin and its opposite end pivotally connected to a longitudinally extending bracket pivot pin;

said U-shaped striker having a pair of forward and aft side walls extending outboard from the closure member, each said side wall having an outwardly opening elongated recess therein defining a raceway terminating in opposed outboard and inboard pivot sockets, said outboard pivot sockets defining a longitudinally extending outboard pivot axis and said inboard pivot sockets defining a longitudinally extending inboard pivot axis;

said latch handle having a pair of longitudinally spaced apart forward and aft prongs, each said prong terminating in a semi-circular cam sized for selective pivotal reception in associated ones of said outboard and inboard opposed pivot sockets;

wherein, with the closure member in position to be latched to the body, said handle and link are initially pivoted outboard about said bracket pin with said handle spaced from said striker, said link adapted to be pivoted inboard seating said cams in their associated inboard pivot sockets without tensing said link;

said raceways being oriented in a direction substantially perpendicular to a longitudinal axis of the elastomeric link with the latch in a latched position such that initially rotating said handle cams in a latching direction about said inboard pivot axis through a predetermined first angle tenses said link to a latching overcenter length that causes said cams to snap outboard on their respective raceways and seat in their associated outboard sockets, continued rotation of said handle about said outboard pivot axis reducing the tension of said link until said link contacts stop means on said striker defining the assembly latched position, whereby said link retains a tensed length less than said first overcenter tensed length; and initially rotating said handle and link in an unlatching direction pivots said handle cams about said outboard axis through a predetermined second angle, so as to tense said link to an unlatching overcenter length greater than said latching overcenter length, thereby unlatching effort prior to causing said cams to snap inboard on their respective raceways and seat in their associated inboard sockets and allowing continued rotation of said handle about said inboard pivot axis to said unlatched position.

* * * * *